US005281052A

United States Patent [19]

Beamer

[11] Patent Number: 5,281,052

[45] Date of Patent: Jan. 25, 1994

[54] MULTI-CONTAINMENT TRENCH SYSTEM

[75] Inventor: John V. Beamer, Atlanta, Ga.

[73] Assignee: Construction Casting Company, Atlanta, Ga.

[21] Appl. No.: 59,221

[22] Filed: May 7, 1993

Related U.S. Application Data

[63] Continuation-in-part of Ser. No. 931,151, Aug. 17, 1992.

[51] Int. Cl.[5] ..... E02B 5/00

[52] U.S. Cl. ..... 405/119; 249/11; 404/4; 405/118

[58] Field of Search ..... 405/118-121, 405/36; 404/2-5; 249/9-11

[56] References Cited

U.S. PATENT DOCUMENTS

| | | | |
|---|---|---|---|
| 1,220,519 | 3/1917 | Lane | 405/122 |
| 1,562,780 | 11/1925 | Mickleson | 249/11 |
| 2,938,437 | 5/1960 | Daley | 404/4 |
| 3,299,785 | 1/1967 | James | 404/4 |
| 3,625,011 | 12/1971 | Stevenson | 405/36 |
| 4,472,078 | 9/1984 | Karbstein | 404/2 |
| 4,878,782 | 11/1989 | Beattie et al. | 405/119 |
| 5,000,621 | 3/1991 | Beamer | 405/118 |

*Primary Examiner*—Dennis L. Taylor
*Attorney, Agent, or Firm*—Needle & Rosenberg

[57] ABSTRACT

A system for forming a multi-walled trench comprising an outer wall, an inner wall disposed within the outer wall and along which the fluid to be contained flows, means for securing in position the inner wall so as to allow expansion and contraction thereof relative to the outer wall and means for vertically adjusting the trench relative to the surface elevation prior to the pouring of concrete. Various embodiments of the securing means are provided.

6 Claims, 5 Drawing Sheets

MULTI-CONTAINMENT TRENCH SYSTEM

CROSS-REFERENCES TO RELATED APPLICATION

This is a continuation-in-part application to my copending application, Ser. No. 07/931,151, filed Aug. 17, 1992.

BACKGROUND OF THE INVENTION

The present invention relates to the construction industry, and more specifically to the formation of a pre-engineered grate or covered multi-walled trench including an assembly for forming the trench and a frame for the assembly. The need for a multiple walled containment trench with frames has evolved with the need to prevent seepage of objectional materials through the trench walls and into the surrounding ground.

The need for this invention has resulted from Federal Regulations, particularly from the E.P.A. For instance, underground tanks used for fuel or other chemicals must have a tank inside a tank. Should a leak occur in the inner holding tank, the fluid would be captured by the outer tank feeding to a low point leak sensor or feeding to a strip sensor along the bottom of the outer tank (such as one made by Rachem Corp.), setting off an alarm that leakage had occurred. It is expected that similar regulations may be forthcoming for trenches containing certain liquids. Therefore, the need exists for multi-walled trenches which allow for leak detection.

The general concept of trench drainage systems has long been used. Trenches are used where liquid run-offs occur, such as in chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it, and is made of a material that will withstand the corrosiveness of the fluid entering the trench. In some applications, the top of the trench may be solidly covered, such as crossing sidewalks or where conduits are carried within the trench and fluid entry is minimal and not necessarily desirable.

Minimal development has been done in the field of double containment trenches with frames to support grates and covers. In the prior art, a double walled polymer concrete channel has been made. These channels were constructed in relatively short lengths, requiring many joints where leaks could occur. Another problem existed in that heavy traffic would also frequently pass over the trenches. In the prior art, proper protection of the inner and outer trench, or liner, was not provided. Thus, failure of the trench or liner could easily occur, causing leakage.

Another disadvantage in the prior art exists in the lack of provisions for replacement of the frame, the inner trench liner, or other trench liners without having to essentially remove the old system and install a new one at an extremely high expense. Furthermore, the inner and outer walls of these containment trenches were attached to each other, thus allowing no independent contraction or expansion of either wall, resulting in buckling and failure of the containment system.

In the prior art, either trenches have no slope or a fixed slope. Thus, the engineer cannot design the trench to his requirements but must use what comes "off the shelf", thus limiting his options. Also, limited widths and depths of trenches have been offered. Therefore, the fluid flow was restricted to the available trenches, instead of trenches being designed for the fluid flow.

Therefore, there exists a need for a multi-containment trench system which will provide a minimum number of joints to reduce possible leakage points.

There exists a need for a multi-containment trench system that can accommodate a variety of temperatures over a wide range without rupturing the walls or breaking the joints apart from either heat, cold, expansion or contraction.

There also exists a need for a multi-containment system that offers an extra protection against leaks at the joints of the trench.

There exists a need for a multi-containment system that offers protection to the inner and outer walls or liners from heavy traffic passing across the trench.

There exists a need for long length trenches with virtually no joints.

Further, there exists a need for a cost effective method of replacing the frame, the trench liner or liners should a leak occur or the liner begins to wear out.

SUMMARY OF THE INVENTION

The disadvantages of the prior art are overcome by the present invention which relates to a grate-covered multiple wall containment trench.

A pair of adjustable frames for maintaining a grate in a stable position along the trench are provided. The frame design is essentially the same as in U.S. Pat. Nos. 5,000,621 and 4,993,878.

It can be seen, therefore, that it is the object of the present invention, to provide an improved multiple-walled containment trench.

It is also an object of the present invention to provide a pre-engineered multiple-containment trench with frames.

It is also an object of the present invention to produce a neutral or sloped trench, as required.

It is also an object of the present invention to provide a multi-containment trench with variable slope abilities.

It is also an object of the present invention to produce a complex trench system at a reasonable cost.

It is also an object of the present invention to provide a modular system which is easy to install.

It is also an object of the present invention to provide a low cost unit which is effective to install, yet easy to produce.

It is also an object of the present invention to provide a frame allowing linear flexing of the wall or walls which will allow for intersections, turns, ends or much longer continuous trenches and to accept the expansion and contraction of very long trenches.

The present invention comprises a trench having an outer wall, an inner wall which fits within the outer wall and along which the fluid to be contained flows, a means for securing in position the inner and outer walls and means for adjusting the multi-walled trench up or down relative to the surface elevation prior to the pouring of concrete. A fluid sensor is provided between the inner and outer walls. The various embodiments of the invention relate to the design of the securing means.

The first embodiment includes the outer wall having an outwardly extending top flange upon which is secured an anchor plate. The trench adjusting means is connected to the plate. A Z-shaped frame as disclosed in the above-noted patents, is detachably secured along its horizontal section to the top of the plate. The inner wall is held in place between the outer wall and a depending leg on the Z-frame.

In the second embodiment, there is no anchor plate and the horizontal section of the frame is detachably secured directly to the flange on the outer wall. In the first two embodiments, the inner wall is installed so that it is allowed to expand and contract.

The third embodiment comprises a means to allow contraction/expansion of the inner wall as the trench intersects with another trench or when the trench makes a turn. The anchor plate includes a horizontal portion which is secured to the top of the flange of the outer wall and a downwardly projecting leg which extends down a portion of the inner surface of the outer wall. The horizontal section of the Z-frame is detachably secured to the top of the horizontal portion of the anchor plate and is wider than the Z-frame of the previous embodiments so as to provide a space between the leg of the anchor plate and the depending leg of the frame in which is disposed the inner wall. The width of the space is adjustable by means of widening the horizontal section of the frame on the anchor plate.

The fourth embodiment of the present invention utilizes the anchor plate of the third embodiment. The outer wall is not provided with a flange but, instead, is bolted directly onto the downwardly projecting leg of the anchor plate. The inner wall is bolted to the inside surface of the depending leg of the Z-frame.

The trench containment unit is extremely flexible in allowing continuous walls with no expansion joints for one hundred feet or more with a sloping or neutral bottom as required. The trench containment unit should be an unbroken unit as long as possible to minimize the number of joints which might leak. The inner wall can be neutral or sloping as needed. The inner wall or walls will normally be secured to the outer wall in such a manner that they will expand from the shallow end toward the deeper discharge end. In other situations, the walls may be secured near the discharge end, near the middle or at both ends. Where long trenches occur, there may be expansion of the trench walls beyond the length of the frames. This expansion must be unimpeded but accommodations for added length, turns and intersections is needed. The use of a standard lap joint filled with flexible sealants will work in many instances but for more complete safety, double containment junction boxes may be used.

An additional means of controlling expansion and contraction is to provide space beneath the newly designed frame for liner flexing at trench ends, turns or intersections. It will be possible to eliminate flexibly sealed joints or junction boxes used for liner expansion. Depending upon trench configuration and the trench liner expansion or contraction, the inner wall or walls may be secured near each trench end allowing compression of the wall or walls to occur between trench ends. Another option is to secure the deep end, forcing expansion toward the shallow end where an expansion cavity exits for the expanded liner. Another option is to secure the shallow end, forcing expansion toward the deep end by using the frame of the third embodiment. Another option is to secure the liner at some point or points between each end, forcing expansion both directions and decreasing the actual expansion or contraction into two or more smaller units. The versatility and lower cost of using the newly-designed frame for flexible liner conditions is great, while reducing costs, minimizing the number of joints and/or junction boxes.

It is also an object of the present invention to provide a frame capable of supporting an outer wall and inner wall, yet able to be taken apart after installation for replacement of the frame, inner wall or outer wall.

It is also an object of this invention to construct an outside trench wall that will accommodate expansion and contraction and an inside wall also capable of expanding or contracting at the same or different rate as the outside wall, without rupturing because of expansion or contraction.

It is also an object to make a long multi-containment trench system, minimizing the number of joints.

It is also an object of the present invention to provide a means of keeping the inner wall apart from the outer wall, allowing for leak sensor placement.

It is also an object of the present invention to provide a multi-containment trench system with frames which allows the frame, and/or inner or outer wall to be replaced without tearing out the trench.

It is a further object of the present invention to provide a frame designed to carry the heaviest loads, yet protect the trench walls below.

It is a further object of the present invention to provide a multi-containment trench so constructed that heavy equipment can pass over it without damaging the walls.

It is still a further object of the present invention to provide a method of suspending the trench system while concrete or other materials are put around the trench.

DETAILED DESCRIPTION OF THE PREFERRED EMBODIMENTS

A. First Embodiment

Figure 1:
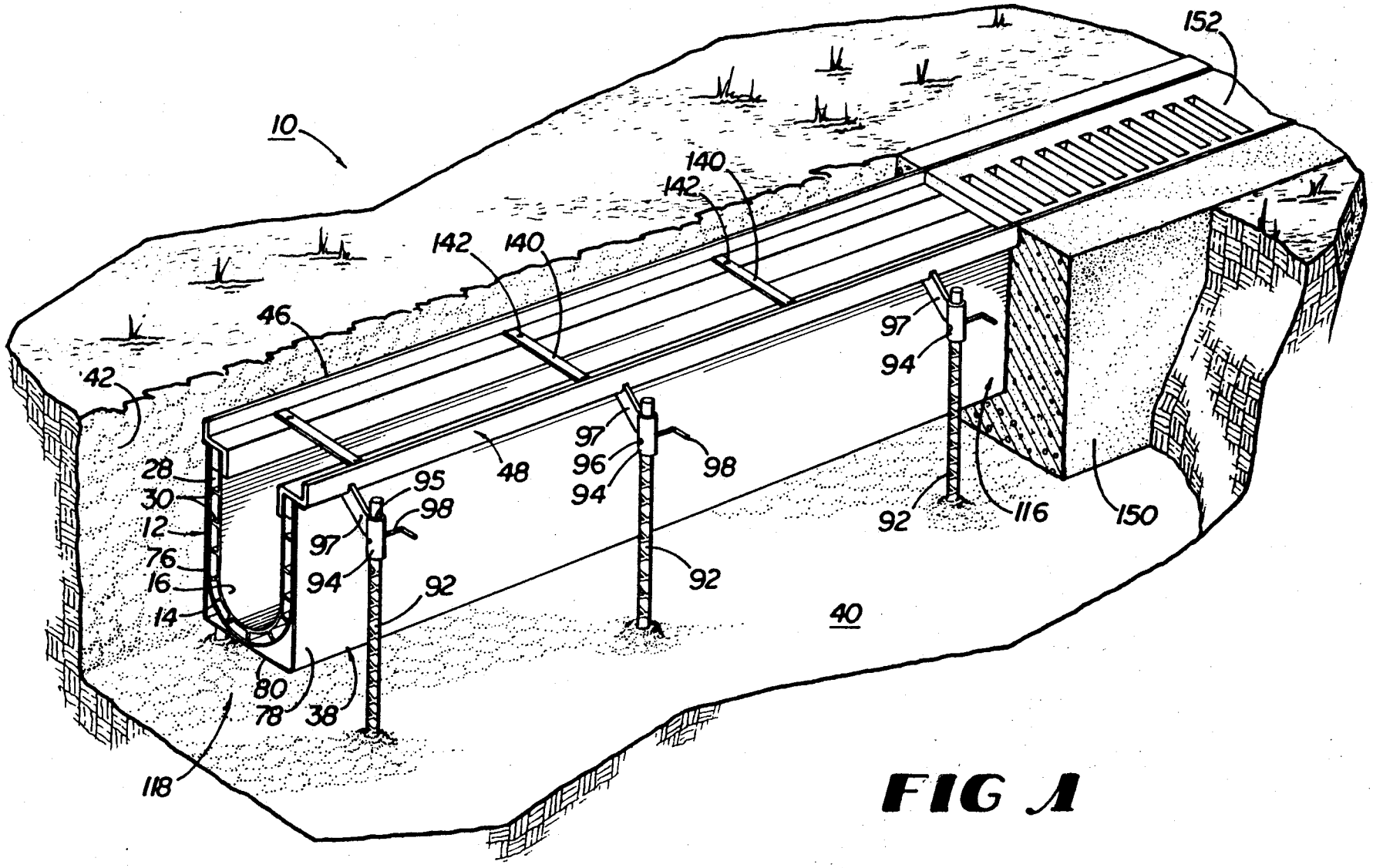
FIG. 1 is a partial perspective view of the multi-containment trench in accord with the present invention with some portions broken away for clarity.
Figure 2:
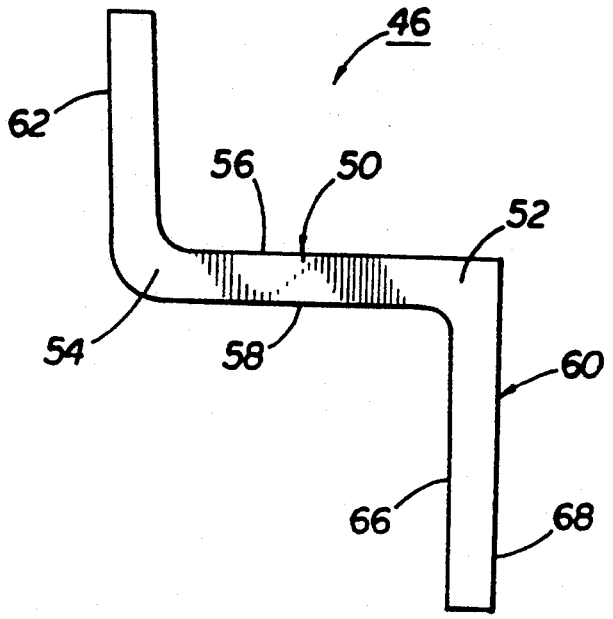
FIG. 2 is an end view in partial cross-sectional view of the first embodiment of the multi-containment trench shown in FIG. 1.

Referring to FIGS. 1 and 2, the numeral 10 represents the trench containment unit of the first embodiment and includes an outer wall or holding pan 12, an inner wall 14, means 16 for securing in position the wall 12 and wall 14 and means 18 for adjusting the multi-walled trench 10 up or down relative to the surface elevation prior to the pouring of the concrete. The outer wall 12 can be formed easily from a variety of rigid materials, such as stainless steel, galvanized or coated steel, aluminum, fiberglass or a plastic compound. The choice of material depends on the properties of the liquids and temperatures expected to be captured in the trench system.

Figure 5:
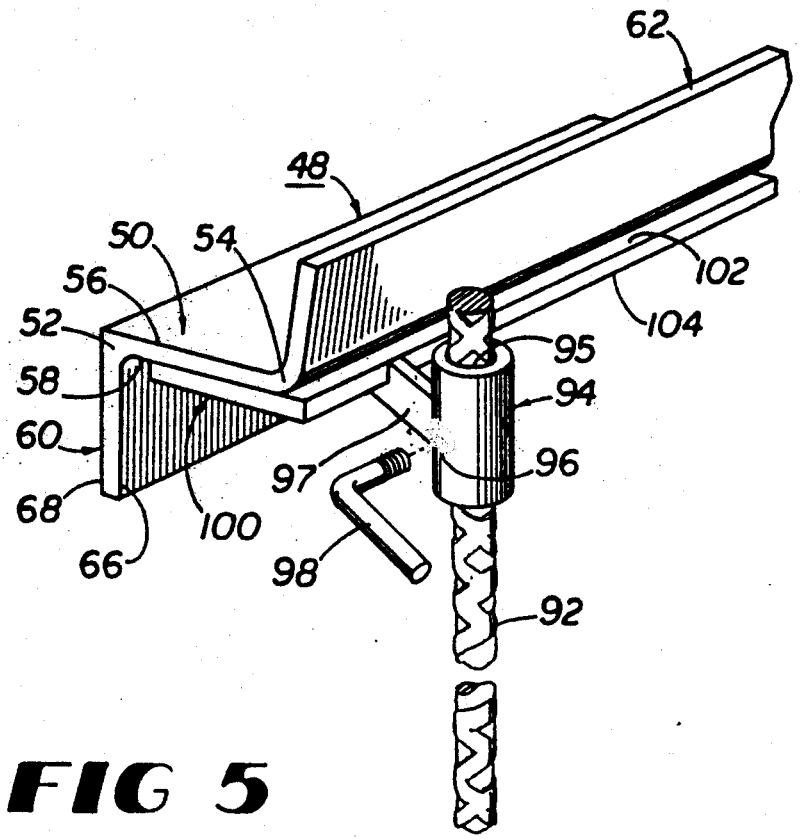
FIG. 5 is a perspective view in partial cross-section of the third embodiment of the multi-containment trench.

The outer wall 12 is eventually encased in concrete (as seen in FIG. 5) and is securely attached, either directly or indirectly, to the securing means 16. The wall 12 includes sides 20 having a laterally extending flange members 22 at their top and which are joined together at their lower ends by bottom 24. A fluid sensor 25 is positioned on the bottom 24 of the wall 12 to detect leaks either in inner wall 14 or wall 12. The inner wall 14 is the element along which the fluids actually flow and is shown having a general U-shape in cross-section with a portion of its surface 26 engaging the bottom 24 of the outer wall 12. The upper end 28 of the inner wall 14 terminates adjacent the flange member 22 and is in contact with the inner surface of the outer wall 12. For additional containment protection, other walls (not shown) may be disposed within the inner wall 14.

The inner wall 14 or walls can be made of metals, galvanized, painted or coated, as well as different plastics, fiberglass or other suitable materials of varying thicknesses depending upon the fluids that will come in contact with the inner surfaces of the walls 14. The inner 14 and outer 12 walls will expand and contract due to the varied temperatures of the fluid and the temperatures surrounding the trench system. In some instances, this does not create a problem as long as the walls 12, 14 and the surrounding material expand and contract at nearly the same rate. In many installations, this is not the case where expansion and contraction can rupture the walls 12, 14 during significant changes in temperature of the fluids in the trench. Therefore, the inner wall 14 is mounted within the outer wall 12 so that it is allowed to expand or contract depending upon the temperature and composition of each, which could vary a significant amount without buckling.

The securing means 16 comprises a Z-shaped frame member 30 having a horizontal section 32 which terminates at one of its ends with upstanding section 34 and at its other end, with depending leg section 36. As seen in FIG. 1, the horizontal section 32 serves as a bearing surface for the grate 35. A rectangular-shaped anchor plate 38 is secured on the top of the flange 22 by means of bolt 40 which is received within adjustment slots (not shown) in the flange 22 and held in place by nut 41. The slots are preferably larger than the bolts 40 so as to accommodate any expansion and contraction of the wall 12 without tearing it from the bolt 40. The plate 38 provides a secondary bearing surface to which the frame 30 may be attached and detached for replacing the frame 30 or the trench inner and/or outer walls 12, 14.

The frame member 30, in turn, is secured to the top of the plate 38 by means of threaded flat-head screws 42.

The anchoring means 18 includes a hollow cylindrical collar 44 that is affixed to the plate 38 by means of connector 46 and which receives therethrough support rod 48 (FIG. 1) that is secured at one of its ends into the bottom of the trench. The collar 44 is fixed at a selected position on each rod 48 by means of bolt 50 being received within opening 52 in the collar 44. Multiple openings 50 and corresponding bolts may also be utilized to enhance securing the position of the collar 44 along the rod 48.

It is preferred that the anchoring means appear at each opposed end of the frame 30, although additional such anchoring means 18 may be provided therebetween with relatively long frames. Various methods may be used to attach the trench system 10 (as well as the other, below-described embodiments) to the anchoring means 18. To illustrate one such method, reference is made to U.S. Pat. No. 4,993,878 issued on Feb. 19, 1991.

The above-described components of the anchoring means 18 are made of rigid components which preferably can be molded, formed or extruded easily into the desired frame shape. Examples of suitable materials include stainless steel, galvanized or coated steel, aluminum, fiberglass or a plastic composition.

B. Second Embodiment

Figure 3:
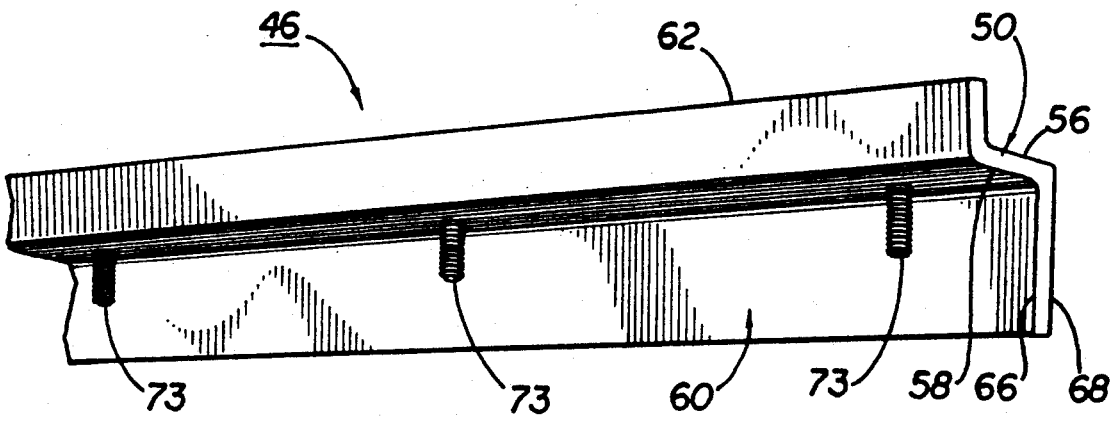
FIG. 3 is an end view in partial perspective of the second embodiment of the present invention.

Referring to FIG. 3, the second embodiment of the present invention is referred to generally by the numeral 100 and comprises an outer wall 112, an inner wall 114, means 116 for securing in position the wall 112 and wall 114 and anchoring means 118. The significant difference between the first and second embodiments 10, 100 is the connection of the frame member 130 to the flange member 122 and the securing of the connector 146 to the flange member 130.

In the second embodiment, the underside of the horizontal section 132 engages directly the top of the flange member 122 and is secured into place by means of bolt 142 being received in slots (not shown) in the flange member 122. The bolt 142 is secured by nut 141. The connector 146 is attached to the frame member 130 adjacent the intersection of the upstanding section 134 with the horizontal section 132.

C. Third Embodiment

Figure 4:
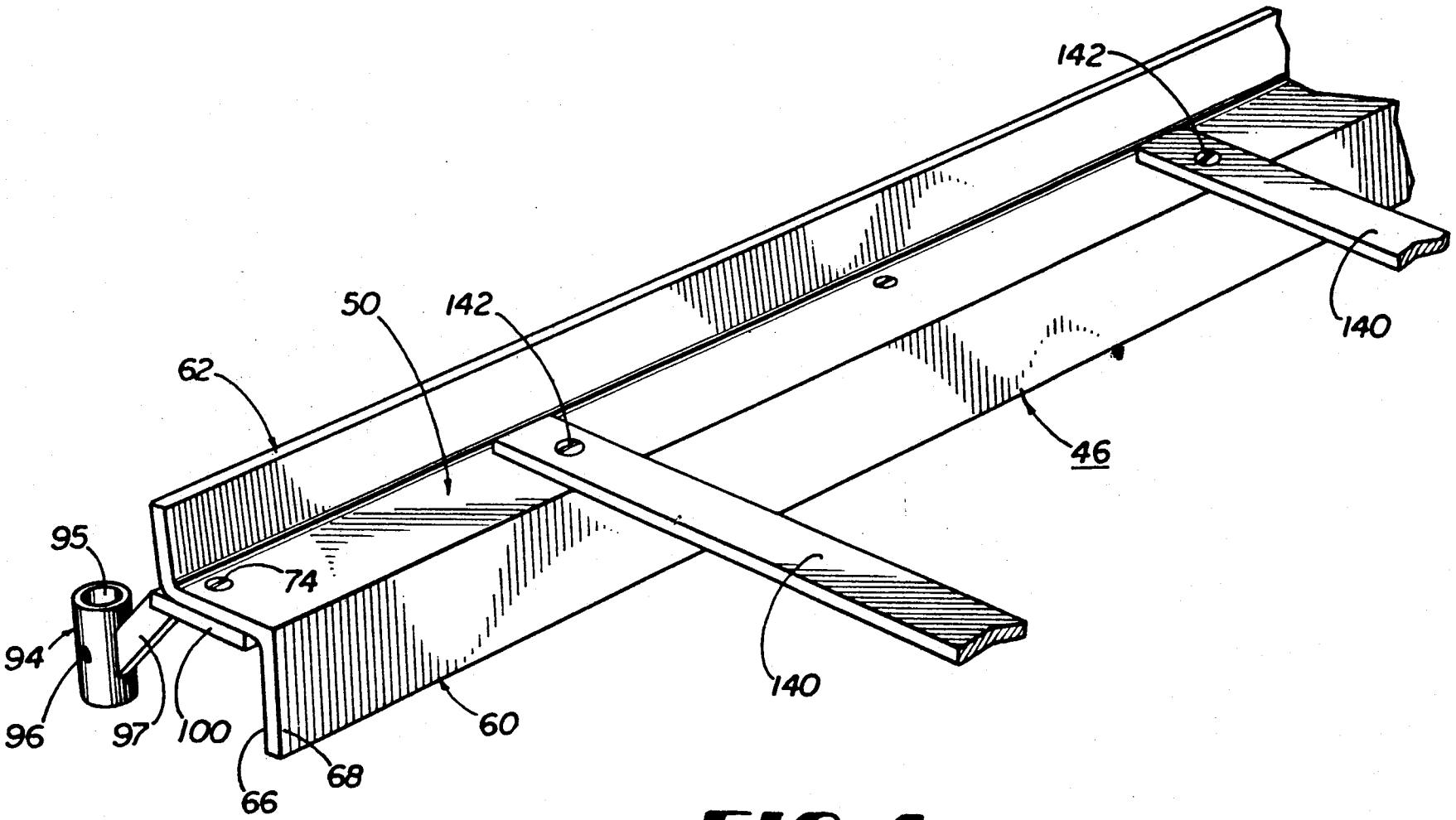
FIG. 4 is a view in partial cross-sectional view of the third embodiment of the present invention.

A problem arises where a trench with flow in one direction intersects with a second trench having a flow in another direction or where a trench has a turn in direction. FIGS. 4 and 5 illustrate a solution to the expansion problem wherein, instead of having the upper portion of the inner wall 14 in snug engagement with the outer wall 12 (as seen in FIGS. 2 and 3), a space 231 is provided between the walls 214, 212 as the trench A nears its intersection with trench B so as to accommodate the expansion/contraction of trench B along the direction of arrow C. The frame member 230 has an elongated horizontal section 232 which terminates at one end with depending leg 236 and at the other end with upstanding section 234. The outer wall 212 is held in place by means of flange 222 being secured to the underside of anchor plate 238 by means of bolt 240 and nut 241. The right side of plate 238 terminates in depending leg member 260 which extends along the inner surface of the outer wall 212 and with the space 231 being between the legs 260, 236.

The dimension of space 231 can vary from one inch to four inches or more and is determined by the placement of horizontal section 232 on plate 238. The width of space 231 and the length of frame 230 will be determined by the amount of expansion and contraction occurring at the intersection of the trench A with trench B. The position of section 232 is fixed by means of being secured by bolts 242 through holes 233 into the top of the anchor plate 238.

The anchoring means 218 includes connector 246 being joined at one of its ends to anchor plate 238 and at its other end to collar 244 which receives therein rod 248. As in the first embodiment, the collar 244 is set on the rod 248 at a certain desired height, depending upon the depth of the trench that is dug and the level of the grate to be received on the horizontal section 232.

As seen in FIG. 5, there is a section 270 which joins frame member 130 to frame member 230 in trench A.

The inner wall 214 has a rear end 215 and a forward end 217, with the rear end 215 being maintained at a higher elevation than end 217 to permit the unimpeded flow of liquid along the inner wall 214 toward the forward end 217.

D. Fourth Embodiment

Figure 7:
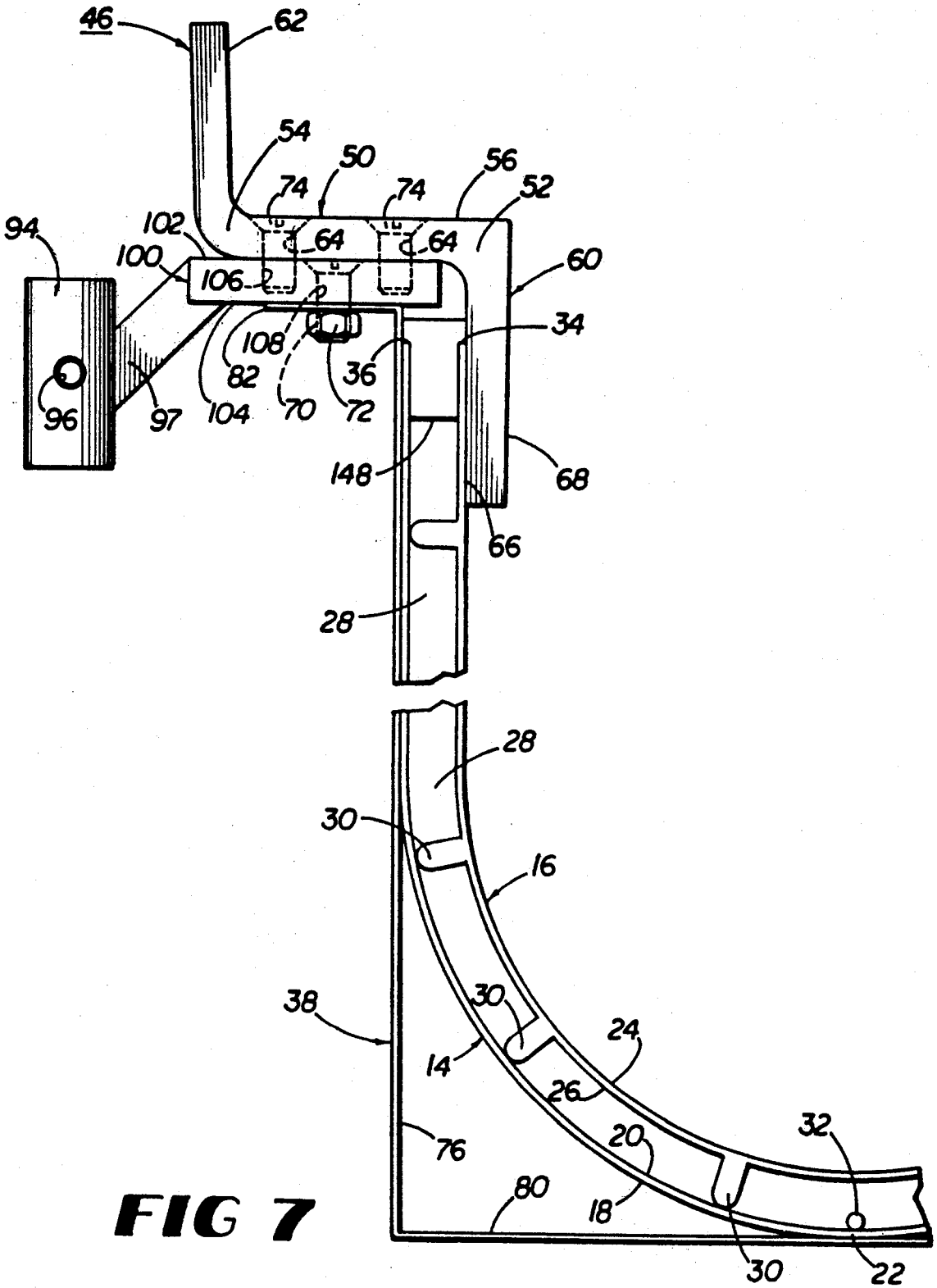
FIG. 7 is an end view in partial cross-section of the fourth embodiment of the present invention.
Figure 1:
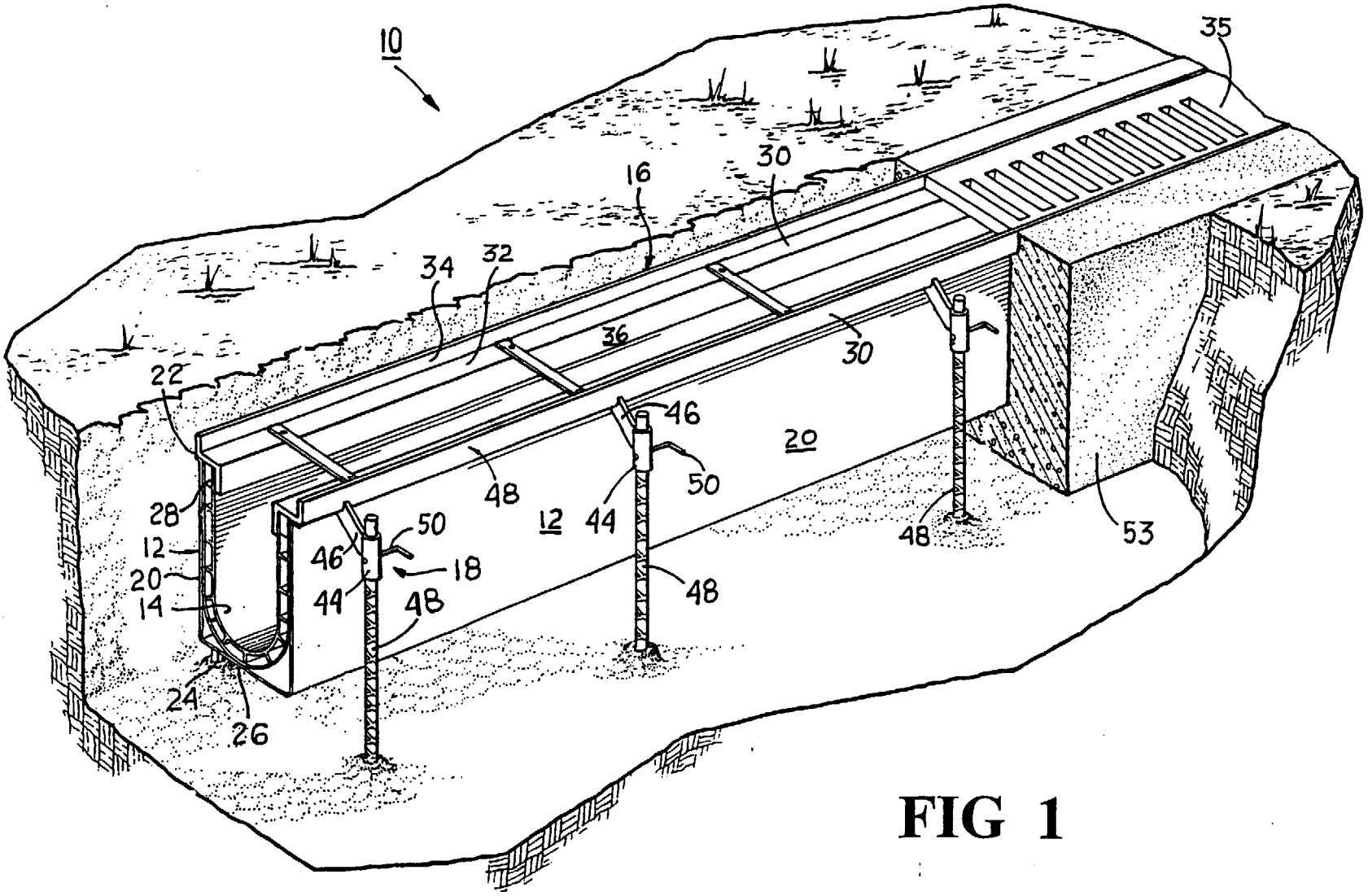
Figure 2:
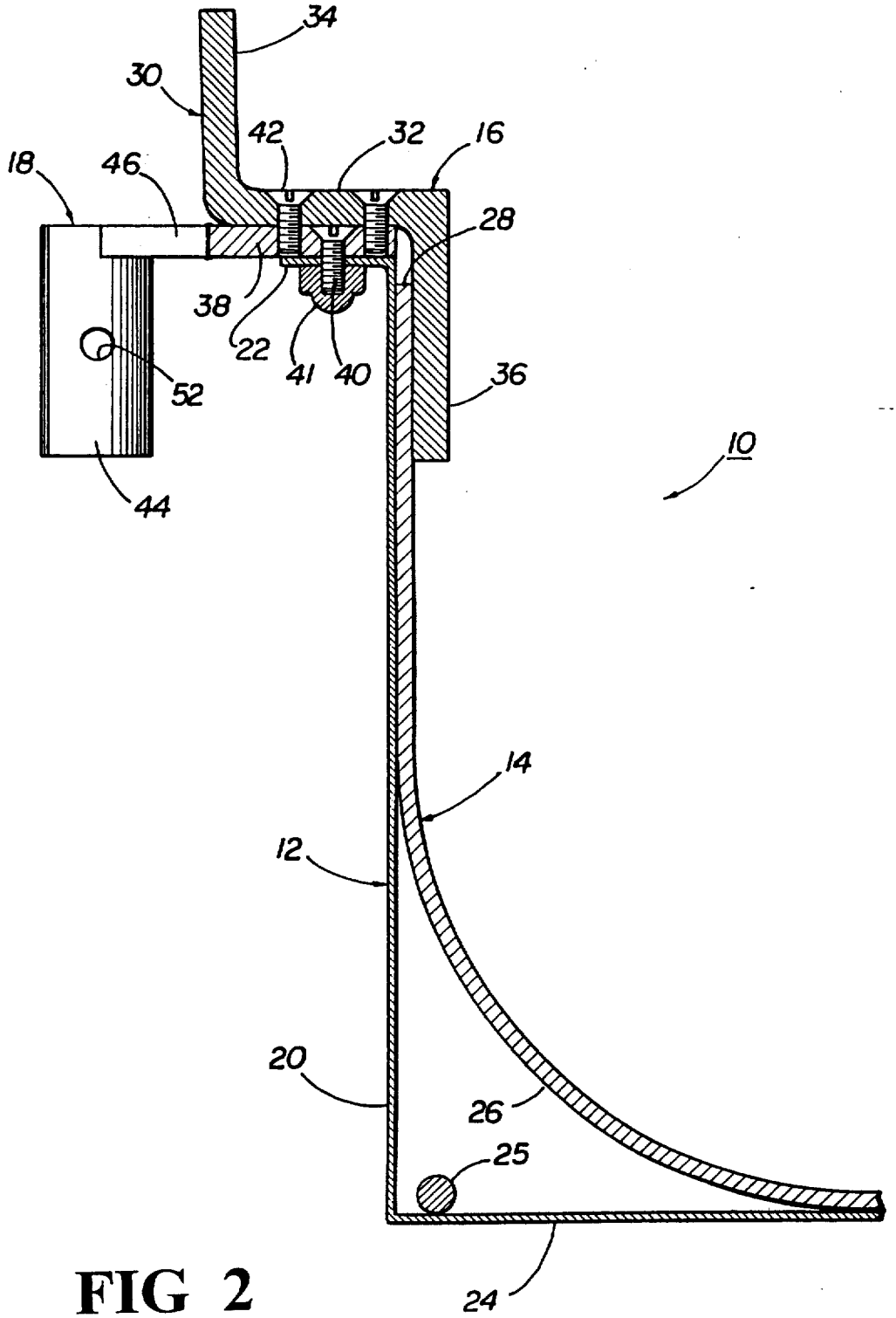
Figure 3:
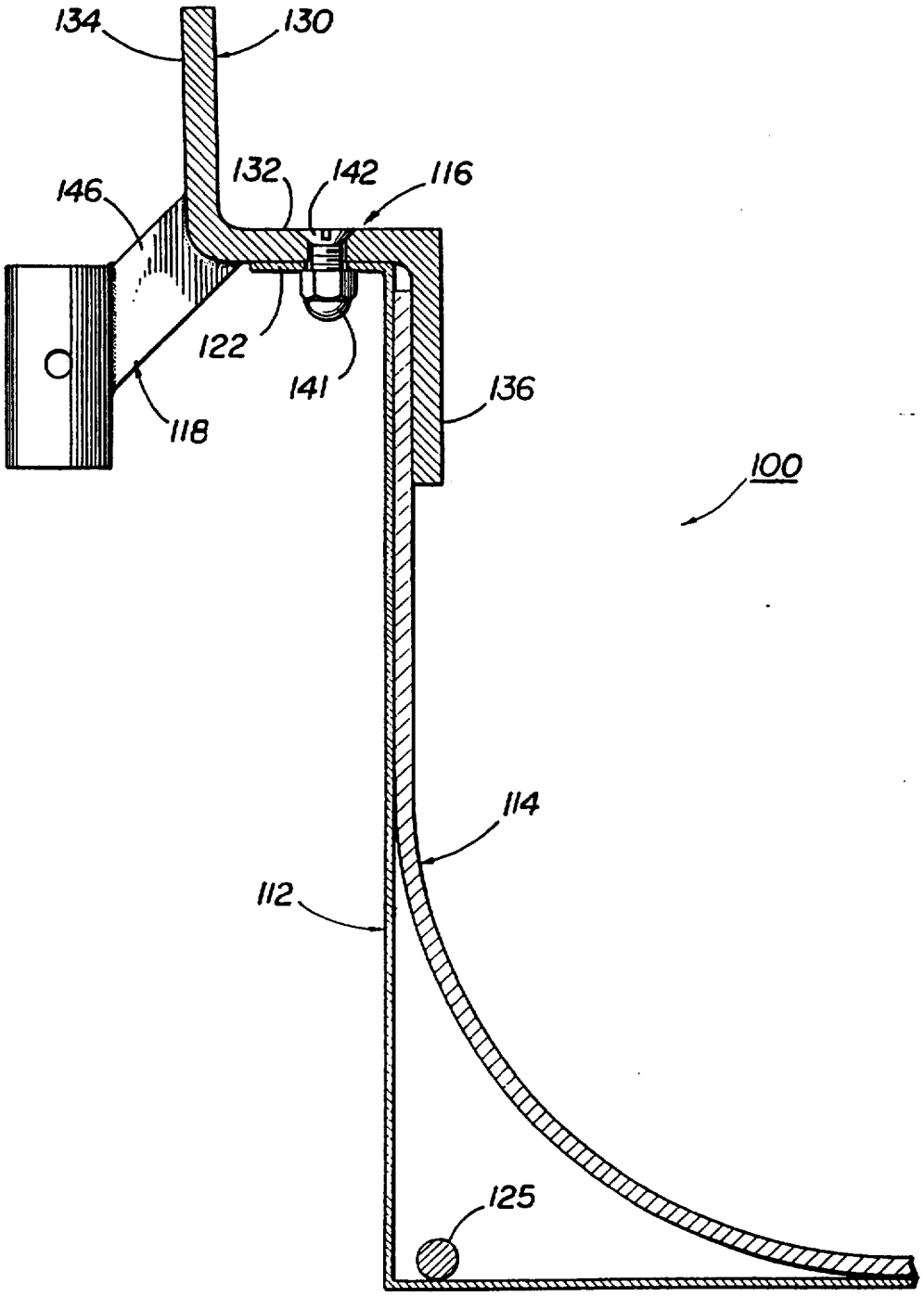
Figure 4:
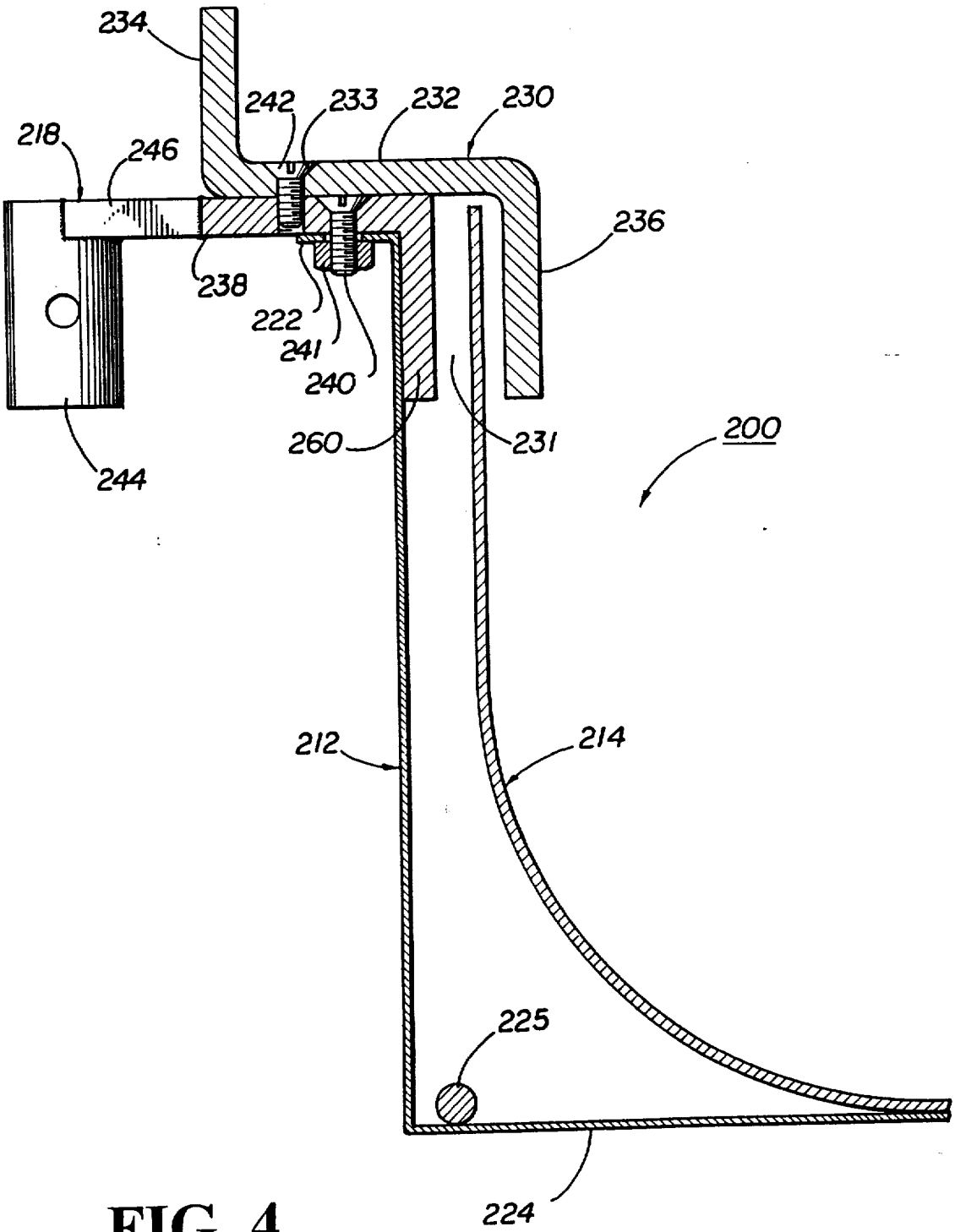
Figure 5:
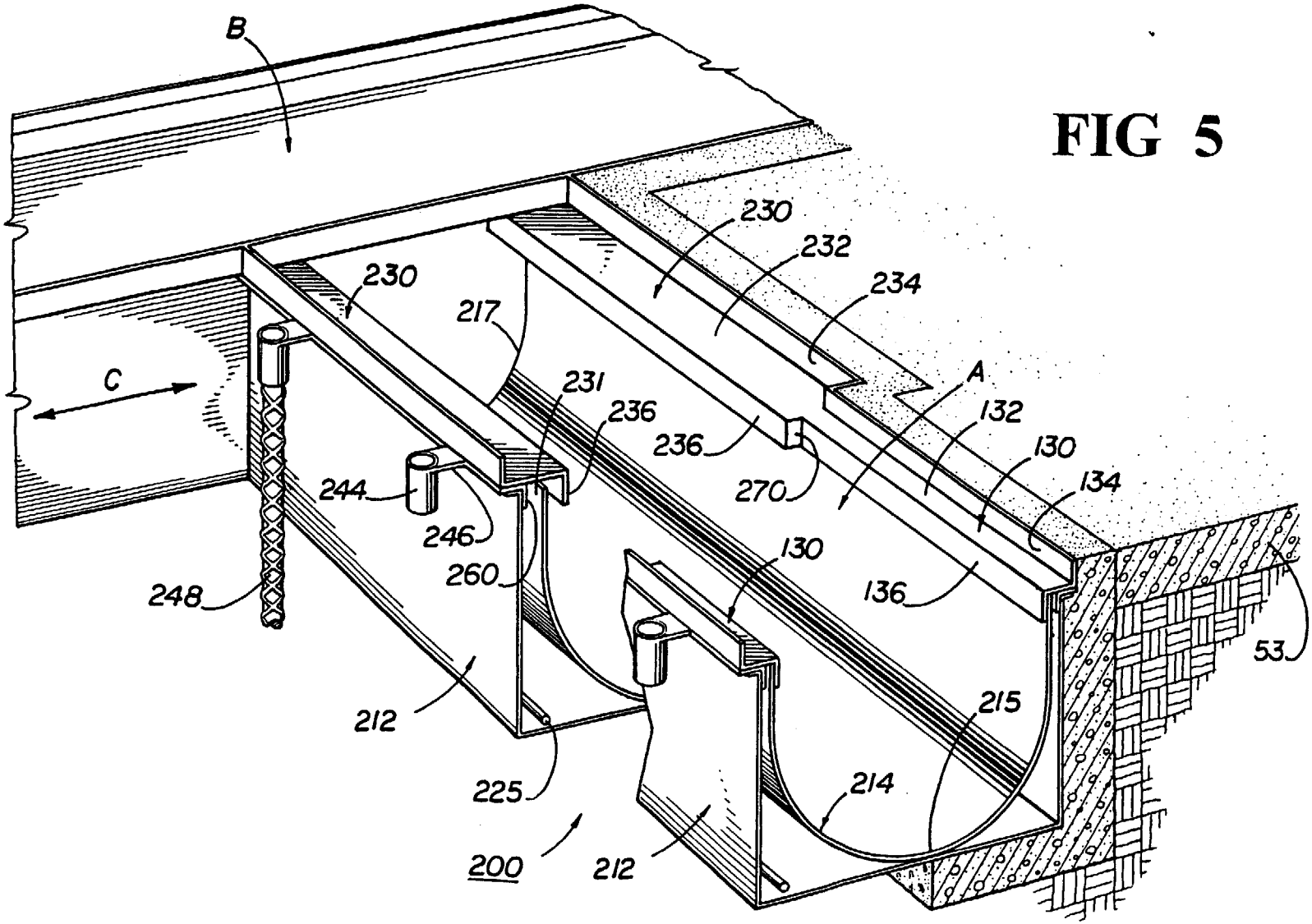
Figure 6:
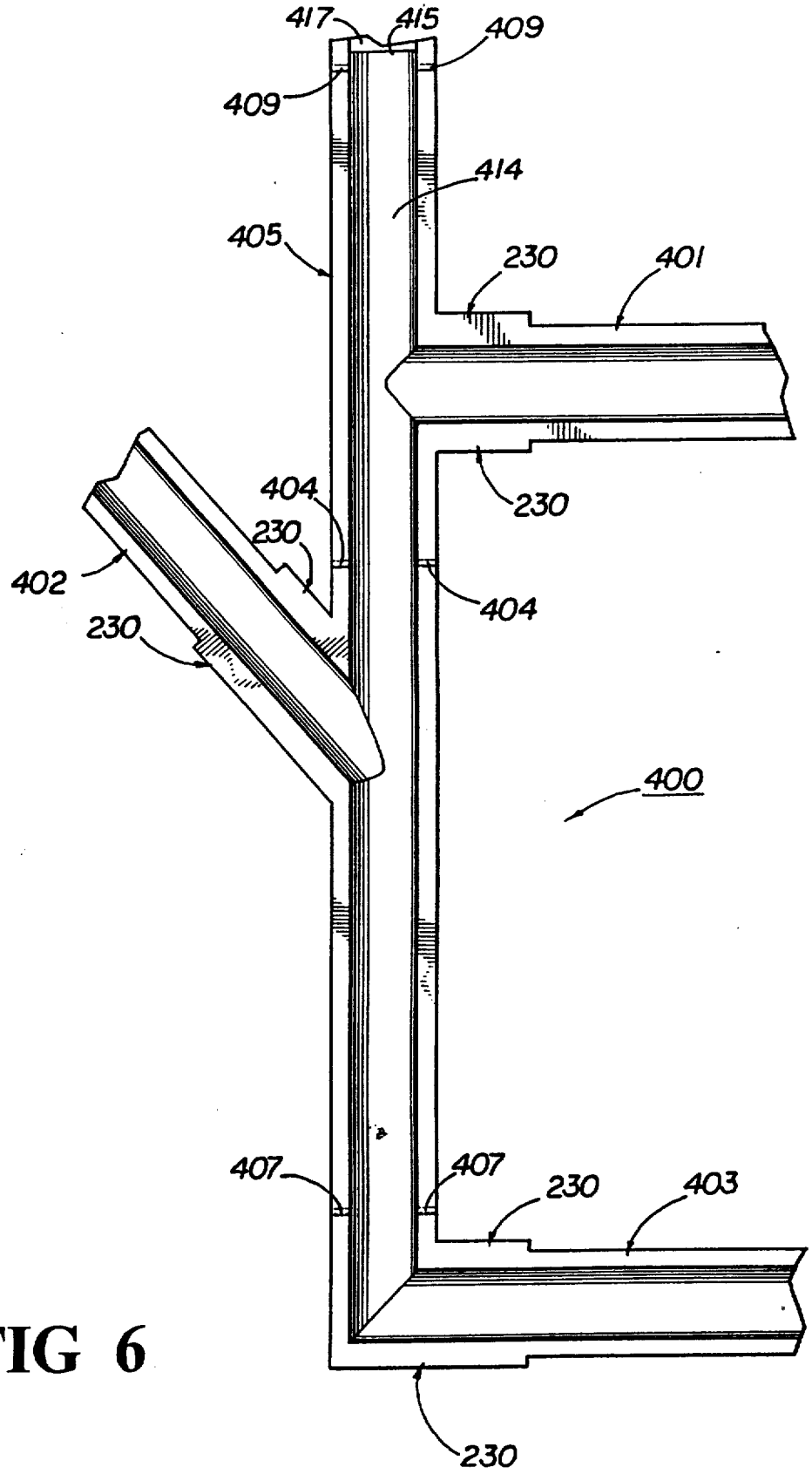
Figure 7:
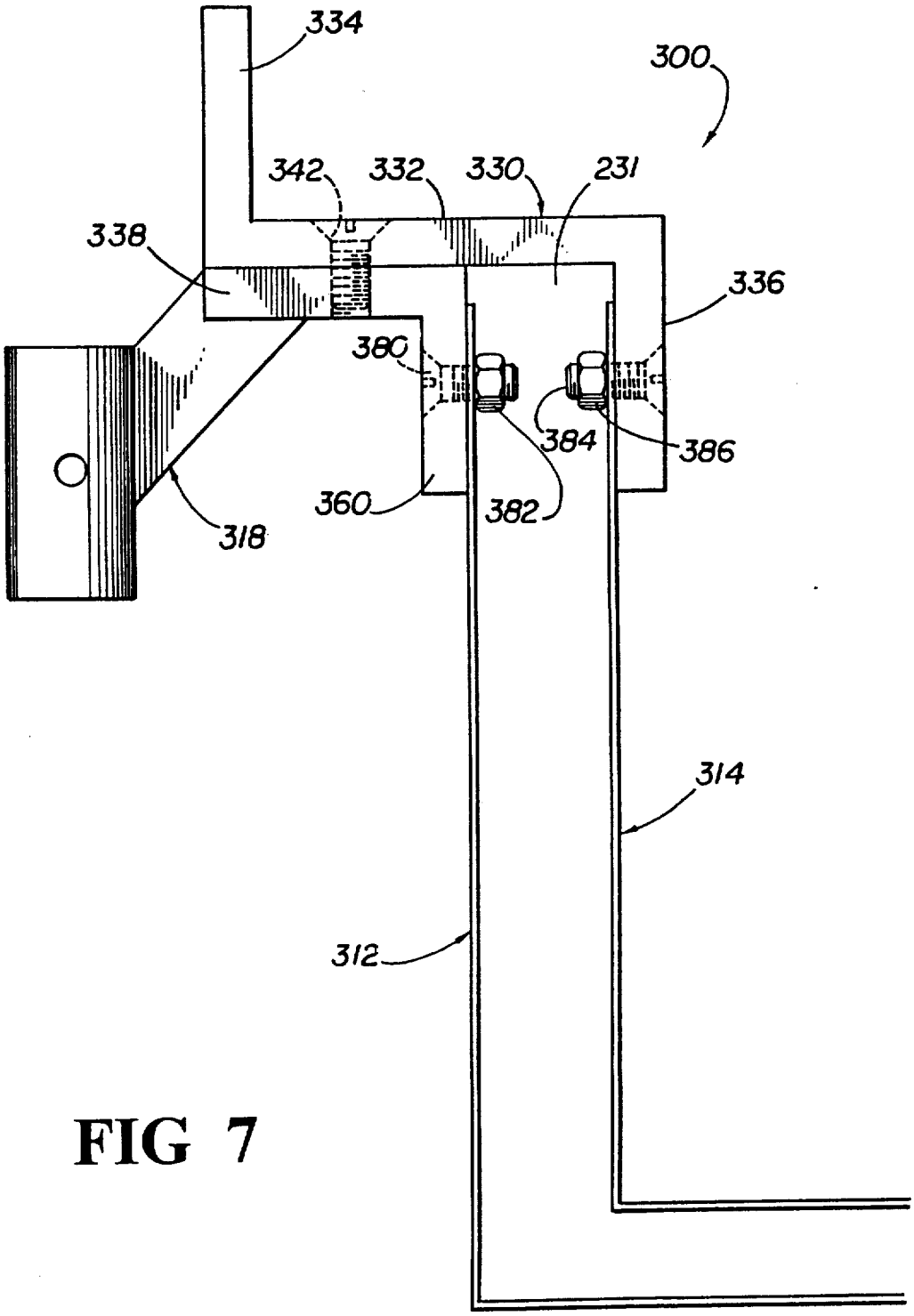

The fourth embodiment 300 shown in FIG. 7 is similar to the third embodiment of FIG. 4 except that the walls 312, 314 are secured to the legs 236, 260. The fourth embodiment 300 can be utilized where the expansion or contraction of the inner wall 14 is small, as with stainless steel, fiberglass and other metal or plastic formulations.

Specifically, the embodiment 300 comprises a Z-shaped frame member 330 having horizontal section 332, upstanding section 334 and depending leg 336. The member 330 is secured to the top of the plate 338 by means of bolt 342. The plate 338 has a depending leg 360 which is parallel to and adjustably spaced from the leg 336 so as to form space 231 therebetween. The anchoring means 318 is similar in construction to the anchoring means 18, 118, 218 discussed above.

Bolt 380 and nut 382 secure outer wall 312 adjacent its top to the outer surface of leg 360. The upper portion of wall 314 is attached to the inner surface of leg 336 by means of bolt 384 and nut 386.

Figure 6:
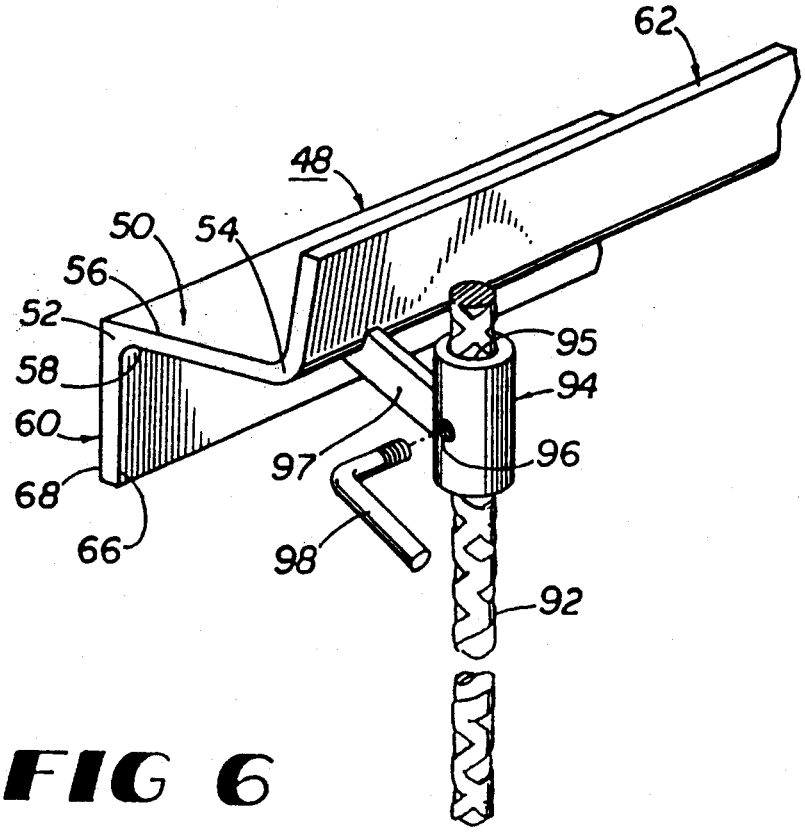
FIG. 6 is a top view of a trench system shown without grates, illustrating the use of the flexible assembly.

When the inner wall is constructed of certain materials, such as polyethylene, polypropylene and polyvinylchloride, the inner wall may expand as much as 4–5 inches over a distance of 100 feet due to a rise in temperature of 100 degrees of the fluids carried by the inner wall. To accommodate this expansion when you have a trench extending in one direction, a "blank end" is added to the inner wall so it may expand. Referring to FIG. 6, the inner wall 414 of trench 405 has an end 415 which extends into covered expansion cavity 417 to accommodate expansion of the liner 414 therein.

Again, referring to FIG. 6, the trench system 400 is illustrated with a T-intersection trench 401, an angular intersection trench 402, a trench turn 403. Adjacent the intersection of the T-trench 401, the trench 402 and trench 403 with trench 405 is shown the Z-frame 230 for expansion and contraction of the inner walls of trench 405 respective to trenches 401, 402 and 403.

Anchoring of the inner and outer walls of the trench to the surrounding concrete or other holding material may be done at many points. For instance, anchoring at 404 would allow for the walls in trench 405 to expand and contract longitudinally in both directions. Anchoring at 407 would allow for expansion and contraction of the outer and inner 414 walls of trench 405 toward end 415 and anchoring for trench 405 at 409 would allow for expansion and contraction toward trench 403.

INSTALLATION AND OPERATION

Referring to FIG. 1, a channel 51 is dug in the ground deep enough to hold the multi-walled trench system of the present invention and the concrete 53 surrounding it. Should the length of the trench be that more than one is needed, the channel 51 should be wide enough at each junction of the multiple trenches to hold a junction box, an expansion joint or a flexible liner frame. The next step is the installation of the respective trench embodiment. The outer wall is placed on temporary blocks which approximate the thickness of the concrete or other material to be placed therein.

In the installation of the first embodiment 10, the plate 38 is loosely secured to the flange 22 of the outer wall by means of the nut and bolt 41, 40. Next, the inner wall 14 is placed inside the outer wall 12 and fluid sensor 25 may be placed on the bottom 24 of the outer wall 12 to detect leakage of fluid from the inner wall 14. The horizontal section 32 of Z-frame 30 is then placed on top of the plate 38, the bolts 42 are tightened in place and the inner surface of the leg 36 pushes the inner wall 14 snugly against the outer wall 12. The nut 41 is then tightened.

In the installation of the second embodiment 100, the frame 130 is connected directly to the anchoring means 118 by means of connector 146. Therefore, the inner wall 114 and the sensor 125 must be included within the outer wall 112 before the outer wall 112 is secured to the frame 130. The remaining steps of the installation of the second embodiment 100 proceeds as above for the first embodiment 10, with the horizontal section 132 of the frame 130 being loosely secured to the flange 122 by means of bolt 142 and nut 141. The leg 136 is moved to the left in FIG. 3 until the inner wall 112 is snugly against the outer wall 114. The nut 141 is then tightened on the bolt 142.

In FIG. 4 an anchor plate 238 will be connected to each collar 244 by a connecting member 246. The bottom surfaces of each of the anchor plates 238 are placed flush against the top surfaces of the flanges 222, so that the flange adjustment slots align with the bolt 240, the bolt 240 passing through the flange hole and with outer wall 212 tight against the downward leg 260, nut 241 is tightened. Next, the inner wall 214 is placed inside the outer wall 212. Fluid sensors 225 may be placed on the bottom 224 of the outer wall 212.

Once the inner wall 214 is in place, the frame members 230 are placed on the top surface of the anchor plates 238 so that the frame bolt holes 233 are aligned with the threaded bolt hole in the anchor plate 238. The frames 230 are then secured to the anchor plates 238 by inserting a threaded bolt or screw 242 into each bolt hole 233 and threadingly attaching the bolt 242 to the corresponding bolt hole in the plate 238.

In the fourth embodiment, referring to FIG. 7, the outer wall 312 is secured to leg 360 of anchor plate 338 by means of bolt 380 and nut 382. At this time, a sensor may be installed in the outer wall 312. Next, the inner wall 314 is attached to leg 336 by means of bolt 384 and nut 386. Installation of the frame 330 on the plate 338 proceeds as in the previously described third embodiment.

Once the respective multi-walled trench system has been assembled, it is arranged in the channel 42 along its ultimate path, is raised approximately to its finished grade, and supported at that grade by supporting members (not shown), such as a set of two-by-fours. A plurality of supporting rods 48 are placed at regular intervals into the ground, one through each collar 44. Once the supporting rods 48 are secure, the trench is adjusted to the finished grade, and is tightly fastened to the supporting rods 48 by bolts 50. The supporting members are removed before the concrete 53 is poured.

When the trench is complete and in place, concrete 53 is poured around it, until the level of the concrete 53 reaches the top of each of the Z-frames. At the top outside of the frame, after the concrete or other material has been poured but before it hardens, it is recommended that a vertical groove (not shown) be formed with a trowel or a removable blocking member placed before pouring. This indentation may be filled with caulking or the coating covering the adjacent flooring (if appropriate), thus improving the seal at the frame. Finally, a cover or grate 35 is placed on each multi-walled trench.

What I claim is:

1. A multi-walled trench comprising:

a. an outer wall, having an outwardly extending flange disposed along its top edge;

b. an inner wall positioned within the outer wall so as to create a cavity therebetween;

c. means for maintaining the inner wall in position in order to allow expansion and contraction thereof relative to the outer wall; and d. means for vertically adjusting the trench relative to the surface elevation prior to the pouring of material to encase the trench therein;

the maintaining means comprising a Z-shaped frame having a horizontal section terminating at one edge with an upstanding portion and at the other edge with a depending leg which extends into and in engagement with the exterior of the inner wall, and means for detachably securing the bottom of the horizontal section to the top of the flange so as to retain the upper portion of the inner wall in engagement with the upper portion of the outer wall.

2. A multi-walled trench as claimed in claim 1 wherein the securing means comprises a flat anchor plate disposed between the bottom of the horizontal section of the frame and the top of the flange and wherein the horizontal section is attached to the plate.

3. A multi-walled trench as claimed in claim 2 wherein the adjusting means is connected to the plate.

4. A multi-walled trench as claimed in claim 1 and further comprising a means for sensing the presence of a fluid within the cavity.

5. A multi-walled trench, comprising:

a. an outer wall having an outwardly extending flange disposed along its top edge;

b. an inner wall positioned within the outer wall so as to create a cavity therebetween;

c. means for maintaining the inner wall in position in order to allow expansion and contraction thereof relative to the outer wall, the maintaining means comprising a Z-shaped frame having a horizontal section terminating at one edge with an upstanding portion and at the other edge with a depending leg which extends into engagement with the interior of the inner wall;

d. means for vertically adjusting the trench relative to the surface elevation prior to the pouring of material to encase the trench therein;

e. a flat anchor plate disposed between the horizontal section of the frame and the flange of the outer wall and having one edge thereof terminating in a depending leg which extends into the interior of the outer wall; and f. means for detachably securing the horizontal section to the flat anchor plate, the upper portion of the inner wall being received within the space between the depending legs to provide room for expansion and contraction of the inner wall.

6. A multi-walled trench as claimed in claim 5 wherein the width of the space is adjusted by the positioning through the securing means of the horizontal section of the frame on the anchor plate.

* * * * *

UNITED STATES PATENT AND TRADEMARK OFFICE

CERTIFICATE OF CORRECTION

PATENT NO. : 5,281,052

DATED : January 25, 1994

INVENTOR(S) : John V. Beamer

It is certified that error appears in the above-indentified patent and that said Letters Patent is hereby corrected as shown below:

The title page, showing an illustrative figure, should be deleted and substitute therefor the attached title page.

Delete Drawing Sheets 1-5, and substitute therefor the Drawing Sheets, consisting of FIGS. 1-5, as shown on the attached pages.

Signed and Sealed this

Twenty-seventh Day of December, 1994

*Attest:*

Bruce Lehman

BRUCE LEHMAN

*Attesting Officer*

*Commissioner of Patents and Trademarks*

US005281052A

United States Patent [19]

Beamer

[11] Patent Number: 5,281,052

[45] Date of Patent: Jan. 25, 1994

[54] MULTI-CONTAINMENT TRENCH SYSTEM

[75] Inventor: John V. Beamer, Atlanta, Ga.

[73] Assignee: Construction Casting Company, Atlanta, Ga.

[21] Appl. No.: 59,221

[22] Filed: May 7, 1993

Related U.S. Application Data

[63] Continuation-in-part of Ser. No. 931,151, Aug. 17, 1992.

[51] Int. Cl.[5] ..... E02B 5/00

[52] U.S. Cl. ..... 405/119; 249/11; 404/4; 405/118

[58] Field of Search ..... 405/118-121, 405/36; 404/2-5; 249/9-11

[56] References Cited

U.S. PATENT DOCUMENTS 1,220,519 3/1917 Lane ..... 405/122
1,562,780 11/1925 Mickleson ..... 249/11
2,938,437 5/1960 Daley ..... 404/4
3,299,785 1/1967 James ..... 404/4
3,625,011 12/1971 Stevenson ..... 405/36
4,472,078 9/1984 Karbstein ..... 404/2
4,878,782 11/1989 Beattie et al. ..... 405/119
5,000,621 3/1991 Beamer ..... 405/118

*Primary Examiner*—Dennis L. Taylor
*Attorney, Agent, or Firm*—Needle & Rosenberg

[57] ABSTRACT

A system for forming a multi-walled trench comprising an outer wall, an inner wall disposed within the outer wall and along which the fluid to be contained flows, means for securing in position the inner wall so as to allow expansion and contraction thereof relative to the outer wall and means for vertically adjusting the trench relative to the surface elevation prior to the pouring of concrete. Various embodiments of the securing means are provided.

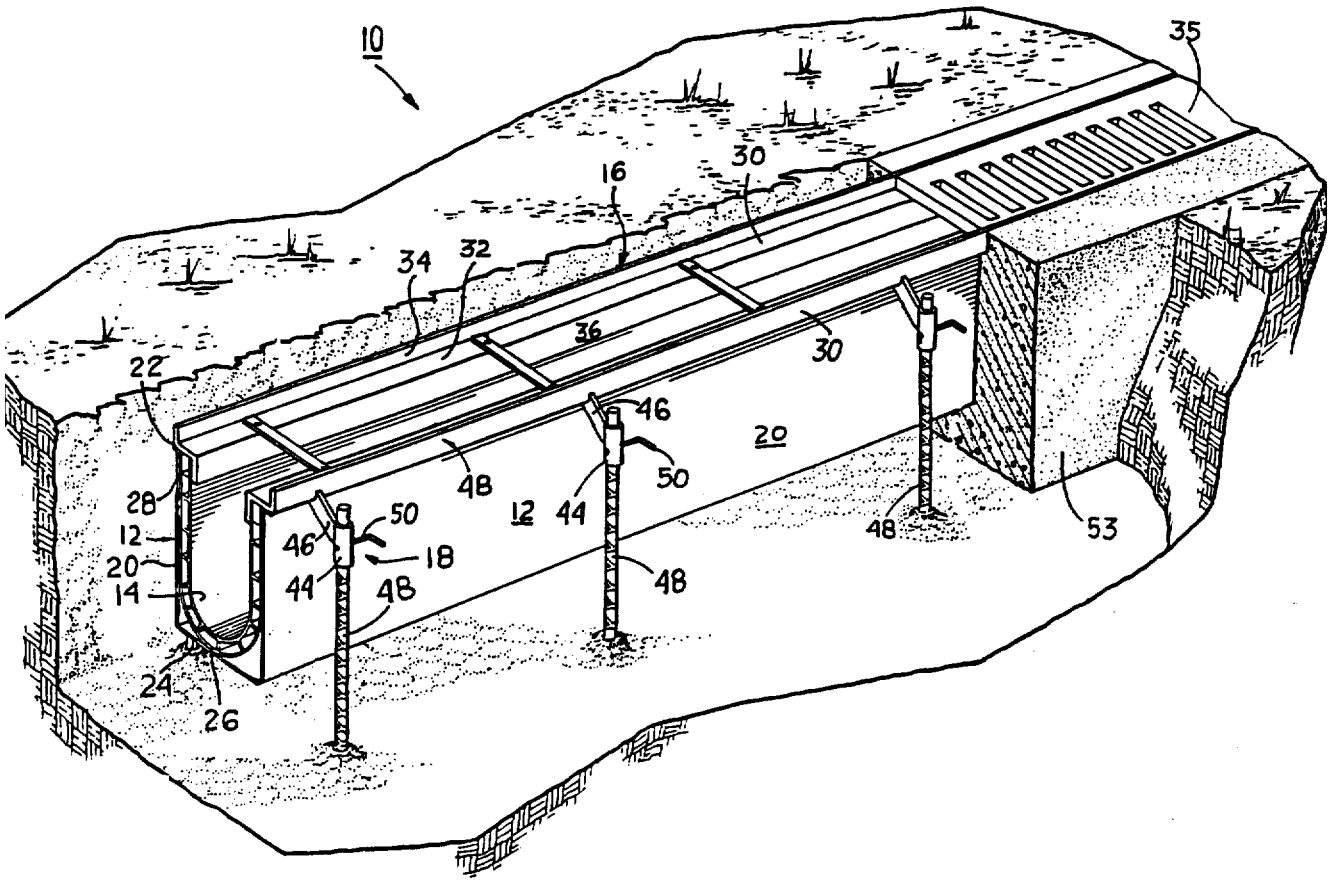

6 Claims, 5 Drawing Sheets